United States Patent [19]

Cockshott et al.

[11] 4,305,551

[45] Dec. 15, 1981

[54] AUTOMATIC DOFFING AND DONNING OF BOBBINS ON THREAD WINDING MACHINES

[75] Inventors: Peter N. Cockshott, Ilkley; Robert J. Cope, Harrogate; David E. Beck, Hampsthwaite, all of England

[73] Assignee: Imperial Chemical Industries Limited, London, England

[21] Appl. No.: 114,350

[22] Filed: Jan. 22, 1980

[30] Foreign Application Priority Data

Feb. 8, 1979 [GB] United Kingdom ..... 04563/79

[51] Int. Cl.[3] ..... B65H 54/20; B65H 67/04

[52] U.S. Cl. ..... 242/35.5 A; 242/18 A

[58] Field of Search ..... 242/35.5 A, 35.5 R, 242/18 A, 18 R, 41, 81

[56] References Cited

U.S. PATENT DOCUMENTS

| | | | |
|---|---|---|---|
| 3,881,603 | 5/1975 | Stotler et al. | 242/35.5 A X |
| 3,964,723 | 6/1976 | Schippers et al. | 242/35.5 A |
| 4,023,743 | 5/1977 | Schippers | 242/35.5 A |
| 4,039,092 | 8/1977 | Schar | 242/35.5 A X |
| 4,041,686 | 8/1977 | Inaba et al. | 242/35.5 A X |
| 4,138,072 | 2/1979 | Aoyama et al. | 242/35.5 A |
| 4,153,211 | 5/1979 | Lenk et al. | 242/35.5 A |

FOREIGN PATENT DOCUMENTS

| | | | |
|---|---|---|---|
| 2141528 | 3/1973 | Fed. Rep. of Germany | 242/41 |
| 47-16715 | 9/1972 | Japan | 242/35.5 A |

*Primary Examiner*—Stanley N. Gilreath

*Attorney, Agent, or Firm*—Cushman, Darby & Cushman

[57] ABSTRACT

An improved arrangement of thread winders comprising forward facing horizontal cantilevered bobbin winding spindles with automatic bobbin push off means and bobbin supports on rotors arranged for automatic bobbin exchange between the spindles and the supports, one rotor being dedicated to each winder, characterized by, in combination, a hoist for each winder providing an upper and a lower operating position, a rotor for each winder comprising at least two horizontal bobbin supports and rotatable about a vertical axis to align either support with the winder spindle in its lower position for bobbin exchange therewith, and a platform above the rotors providing operator access to the winders in their upper position.

1 Claim, 1 Drawing Figure

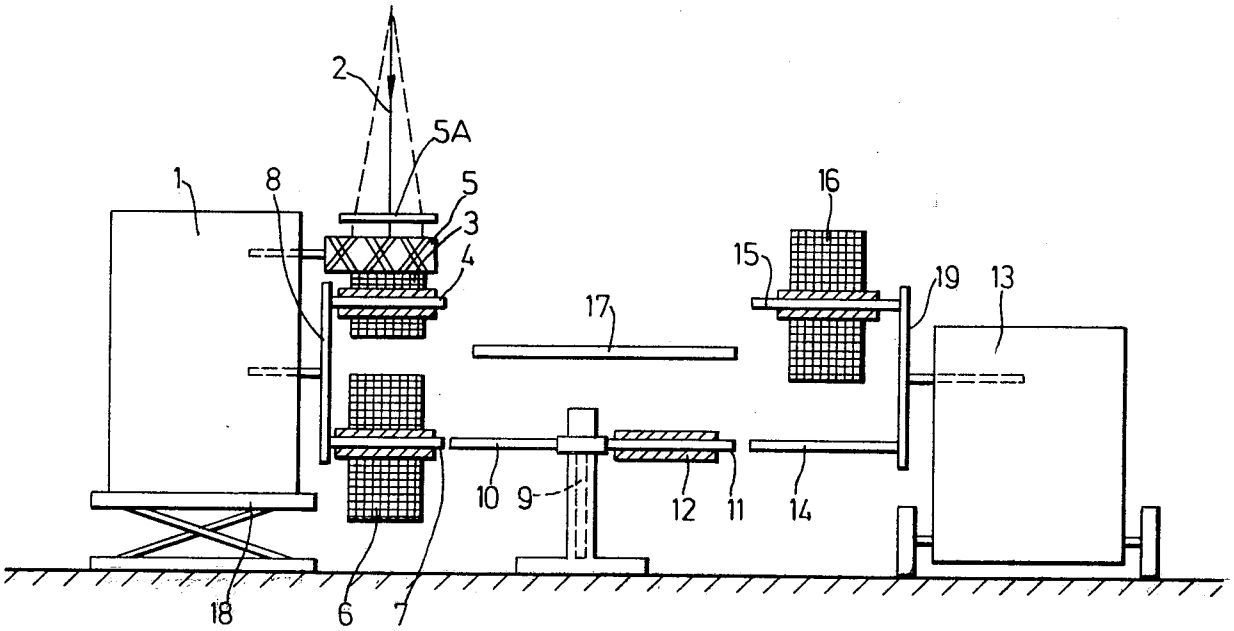
1
2
3
4
5
5A
6
7
8
9
10
11
12
13
14
15
16
17
18
19

AUTOMATIC DOFFING AND DONNING OF BOBBINS ON THREAD WINDING MACHINES

This invention relates to automatic bobbin changing in the operation of multistation thread winders of the kind comprising forward facing horizontal cantilevered bobbin winding spindles with automatic bobbin push off means. It is known to use a vehicle moveable into cooperating position in front of each winding station, the vehicle comprising a a pair of horizontal cantilevered bobbin supports mounted on a rotor, by rotation of which around a horizontal axis each bobbin support is alignable in turn with the winding spindle, so that a full bobbin may be transferred by the push off means from the spindle to an empty support and after rotation of the rotory an empty bobbin may be similarly transferred from the other support to the empty spindle. The vehicle transports full bobbins to a delivery station and receives empty bobbins at a receiving station.

With a large number of winding stations, problems arise in the use of such equipment. Control of package size requires precise timing of bobbin changing, and it is difficult to achieve the necessary vehicle mobility to service each spindle on demand especially when bobbin changing is irregular rather than sequential along a bank of winders. It has been proposed to solve this problem by providing a dedicated bobbin transfer rotor of the kind described in front of each winding station. This arrangement however creates other problems. Operator access to the machine threadline is made difficult and hazardous by the permanent presence and operational movement of the bobbin transfer rotors in front of the winders even when these are only capable of winding single cops; and rotors capable of receiving twin cops would effectively prevent operator access. Machine construction is also made difficult and more expensive by the need to provide bobbin transport means facing the rotors and underneath the winding stations.

According to the present invention we provide an improved arrangement of automatic thread winding equipment comprising in combination firstly a set of thread winders comprising forward facing horizontal cantilevered bobbin winding spindles with automatic bobbin push off means each winding being mounted on a hoist providing an upper and a lower operating position, secondly a set of bobbin transfer rotors one dedicated to each winder and each comprising at least one pair of horizontal and coaxially opposed bobbin supports alignable by rotation of the rotor about a vertical axis to cooperate with the winder in its lower position and thirdly an operator platform above the bobbin exchange rotors providing access to the winders in their upper position and associated threadline processing equipment above them. The rotors may be symmetrical with identical pairs of bobbin supports, or one of the pair may be dedicated to full bobbin handling and the other to empty bobbin handling.

Equipment according to this invention provides safe operator access irrespective of whether the bobbin transfer rotors are designed for single or twin cop winding, together with precisely timed bobbin exchange between winding spindles and rotors on demand in any sequence, and bobbin exchange between the rotors and further handling means at convenience. Equipment according to this invention is readily useable in conjunction with manual bobbin loading and unloading of the rotors, but preferably it is used in conjunction with an automatic bobbin exchange vehicle.

The rotors of the present invention may be fitted with any known mechanisms to suit cooperation with different designs of winder. For instance for use with twin cop winders the push off means associated with a rotor bobbin support arm may need to be designed to position independently each bobbin loaded onto the winder spindle whereas for use with single cop winders simpler push off means will be adequate. For use with turret winders having two spindle positions, one for winding and other for bobbin exchange, the rotor bobbin supports receive only stationary bobbins and need not be rotatable on their cantilevered axes; but for use with winders which require bobbin exchange from a rotating spindle the rotor bobbin supports can be rotatable.

The accompanying FIGURE shows schematically in elevation one arrangement of equipment according to the present invention, in which a yarn winding unit 1 receives a yarn 2 and winds it on to a bobbin 3 on spindle 4. The bobbin 3 cooperates with a drive roll and traverse guide 5 and 5A. A second full bobbin 6 on spindle 7 awaits doffing, spindles 4 and 7 being mounted on a turret 8 actuated to interchange the spindle positions when the bobbin being wound is full, and transfer the advancing yarn to the empty bobbin. Rotor 9 has a bobbin support 10 aligned with spindle 7 ready for bobbin transfer and an opposed bobbin support 11 carrying an empty bobbin 12.

A vehicle 13 has an empty bobbin support 14 aligned with support 11 and another bobbin support 15 carrying a full bobbin 16, both bobbin supports being mounted on a turret 19. Above rotor 10 is a platform 17 on which an operator may stand. Winding unit 1 is supported on a hoist 18 which the operator may actuate to raise the winder unit so that its base is aligned with platform 17. The operator may thus string up the yarn on unit 1, and may manually doff and don bobbins with unit 1 in its upper position; and he may lower the unit to its lower position for automatic operation with rotor 9 and vehicle 13.

We claim:

1. An improved automatic doffing thread winder arrangement comprising: a set of thread winders each comprising forward facing horizontal cantilevered bobbin winding spindles; a set of hoists each providing an upper and a lower operating position for a thread winder; a set of bobbing support rotors; one for each thread winder, each rotor being rotatable about a vertical axis and comprising at least two horizontal bobbin supports alignable by rotation of the rotor with a winder spindle when in its lower position; and a platform above the rotors providing operator access to the winders when in their upper position.

* * * * *